United States Patent [19]

St. Clair

[11] 4,393,792

[45] Jul. 19, 1983

[54] APPARATUS FOR MATTRESS MANUFACTURE

[75] Inventor: Albert R. St. Clair, Hamilton, Ohio

[73] Assignee: Simmons U.S.A. Corporation, Atlanta, Ga.

[21] Appl. No.: 268,271

[22] Filed: May 29, 1981

[51] Int. Cl.[3] ..... D05B 11/00

[52] U.S. Cl. ..... 112/3 R

[58] Field of Search ..... 29/433, 435, 91–91.8; 5/477; 112/3, 221, 40; 28/114, 107

[56] References Cited

U.S. PATENT DOCUMENTS

| | | | |
|---|---|---|---|
| 1,677,232 | 7/1928 | Gail . | |
| 2,100,844 | 11/1937 | Foster | 112/221 X |
| 2,805,429 | 9/1957 | Woller | 5/353 |
| 3,168,792 | 2/1965 | Stumpf | 29/433 |

*Primary Examiner*—Werner H. Schroeder
*Assistant Examiner*—Andrew M. Falik
*Attorney, Agent, or Firm*—Fitch, Even, Tabin & Flannery

[57] ABSTRACT

An apparatus for the manufacture of mattress cores of cloth-pocketed wire springs comprising a support on a frame for holding an assembly of such springs. The support is reciprocated relative to the frame on a linear bearing mechanism by a fluid actuated cable cylinder.

6 Claims, 9 Drawing Figures

Fig. 1.
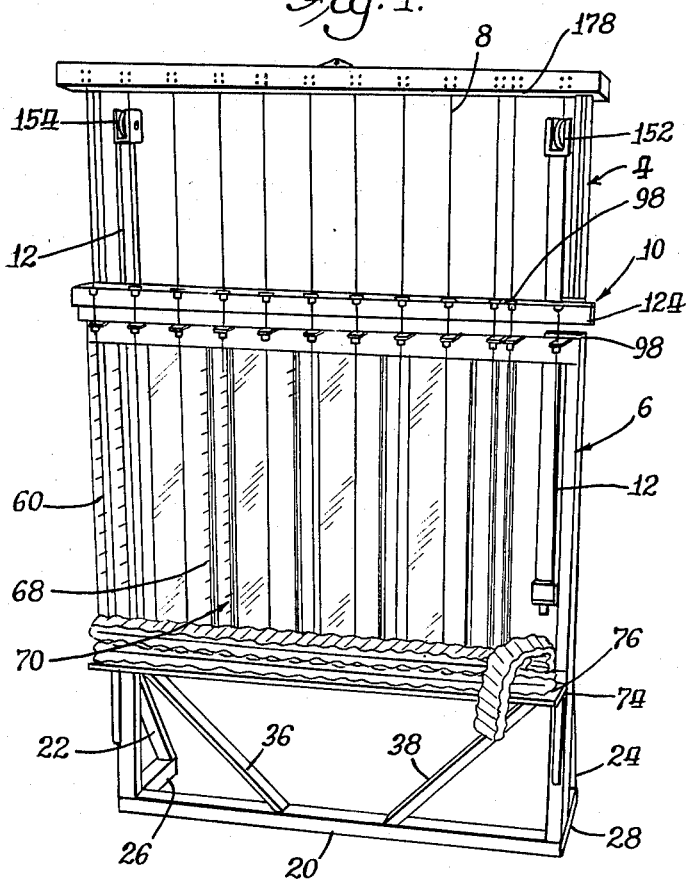
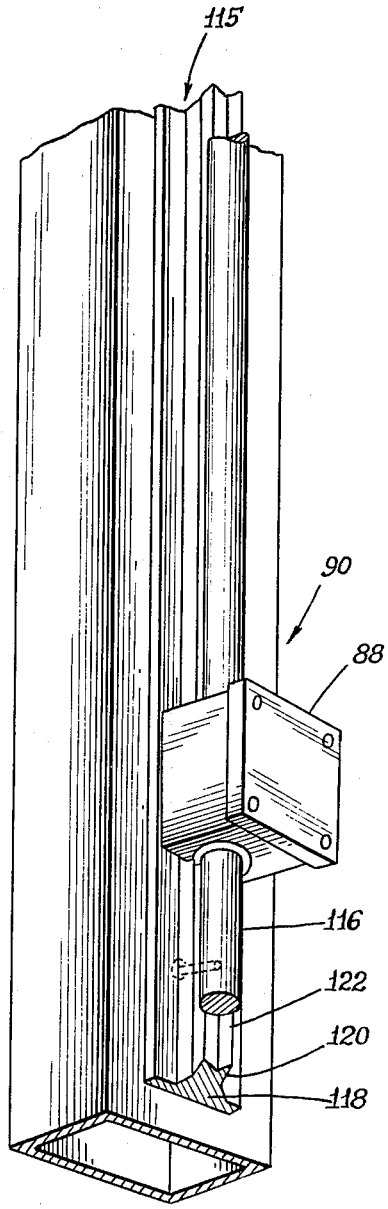
Fig. 6.
Fig. 5.
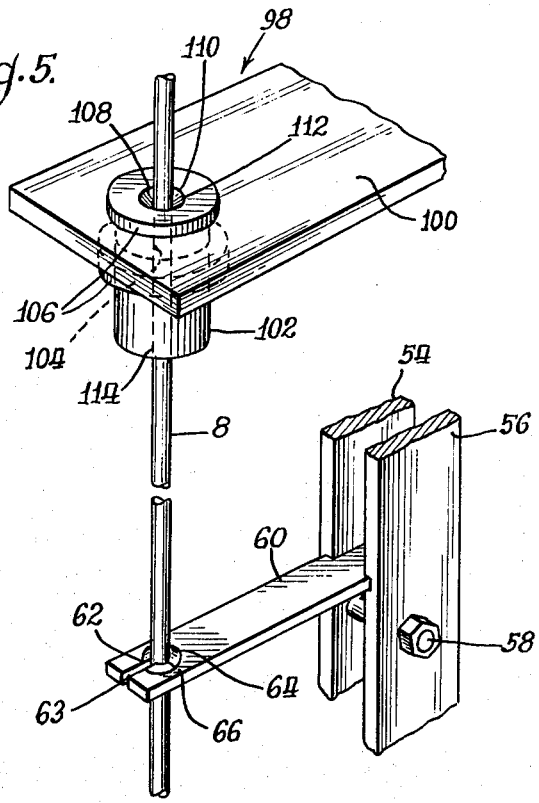

APPARATUS FOR MATTRESS MANUFACTURE

The invention relates to improvements in mattress manufacture and has particular reference to the manufacture of mattress cores of cloth-pocketed wire springs. The invention particularly relates to the manufacture of cores for inner spring mattresses of the general type disclosed in U.S. patent, issued in the name of John F. Gail, No. 1,677,232, on an apparatus of the general type disclosed in the U.S. Pat. No. 2,805,429 to Woller.

A pocketed spring core for a mattress is typically composed of a series of nested rows of integrally connected closed textile fabric pockets, each pocket containing a double ended coil wire axially vertical spring. The strips of fabric for containing the rows of springs in the core of the mattress are usually made of doubled or folded lengths of textile sheet material secured together at spaced intervals to form individual pockets for the coil wire springs, and longitudinally seamed to close the ends of the pockets after the springs have been inserted.

The coil wire springs of such a construction may be cylindrical, or they may be barrel-shaped, i.e., the diameter of the turns of the springs in the pockets is greater in the intermediate zone of the spring than at its ends.

For the assembly of a pocket-spring core, it has been the general practice to make up in advance a series of strips of spring filled pockets or a continuous length of such pockets. Strips of such pockets are then arranged in rows sufficient in number and of the proper length to constitute a core of a mattress of desired dimensions. In doing this, the pockets are arranged in rows on a vertical support comprising vertical bars with guide fingers or pegs extending forwardly and perpendicularly therefrom. These pegs or fingers are aligned vertically and spaced a distance equal to the space occupied in the assembly by a pair of nested strips of pockets. After assembling, the strips of springs are tied by twine inserted through the core by pushing or pulling the twine through the core with needles which have a length exceeding that of the core, and which are guided by bushings in the guide fingers. The assembling operation of the spring pockets onto the support is described in detail in U.S. Pat. No. 2,805,429 to Woller which is incorporated by reference as if fully rewritten herein.

The assembling operation is preferably made on a support which can be moved vertically on a stationary frame by power into various positions to suit the convenience of the operator making the assembly. The strips of pockets are laid upon the guide fingers of the support with the axes of the springs parallel to the fingers. The fingers which extend from the frame not only support the assembled strips and guide the needles, but also aid the operator by locating the strips during assembly. The bank of downwardly-pointed needles, mounted at their upper ends on the stationary frame, are inserted into the core by raising the vertical support relative to the frame by a drive mechanism.

Although it may be possible to draw the ends of the twine through the mattress core by the insertion of the needles relative to the core, it is more convenient to first push the needles through the core and then attach the ends of the twine lengths to the needles so that the lengths of twine are drawn through the core by the withdrawal of the needles.

Thus, after the needles are pushed through the core, the operator threads the ends of a pre-cut length of twine through the eyes of a pair of adjacent needles. On the back stroke, the ends of the twine are pulled upwardly through the core, the ends of the twine are released from the needle, and a knot tied, as previously described.

It is, of course, immaterial whether this reciprocation or needle operation is effected by moving the spring assembly or by moving the needles, but has been found more convenient to move the assembly while keeping the needles at all times stationary on the frame.

Difficulty has been encountered in the operation of thrusting the needles through the core. Frictional resistance to the passage of the needles through multiple layers of fabric builds up quickly, and the needles occasionally will engage the wire of a spring which may cause the needle to bow, and if not immediately detected, to kink or even break. This results in expense by virtue of lost material, labor, and production. Needle damage had previously been minimized by using a special gabled shaped abutment on the needle bushings of the fingers; and circular sensors surrounding the needles also have been employed, where upon deformation of the needle, the sensor would be contacted and the machine shut down to avoid needle breakage. Notwithstanding the aforedescribed techniques, needle deformation and breakage has remained a problem in manufacturing pocketed-spring mattress cores.

It is the object of the present invention to provide an improved apparatus for assembling mattress cores of the general type described which inserts the needles through the core with a smooth action, and with needle support and guidance which reduces needle deformation, bending, and breakage.

The accomplishment of these objectives by the invention will be apparent from the following detailed description made in reference to the accompanying drawings, of which:

FIG. 1 is a perspective view of the apparatus in accordance with the invention with certain parts removed for clarity;

FIG. 5 is an enlarged perspective view of the needle guide units;

FIG. 6 is an enlarged perspective view of a pillow block, and an associated shaft support rail and shaft;

Figure 2:
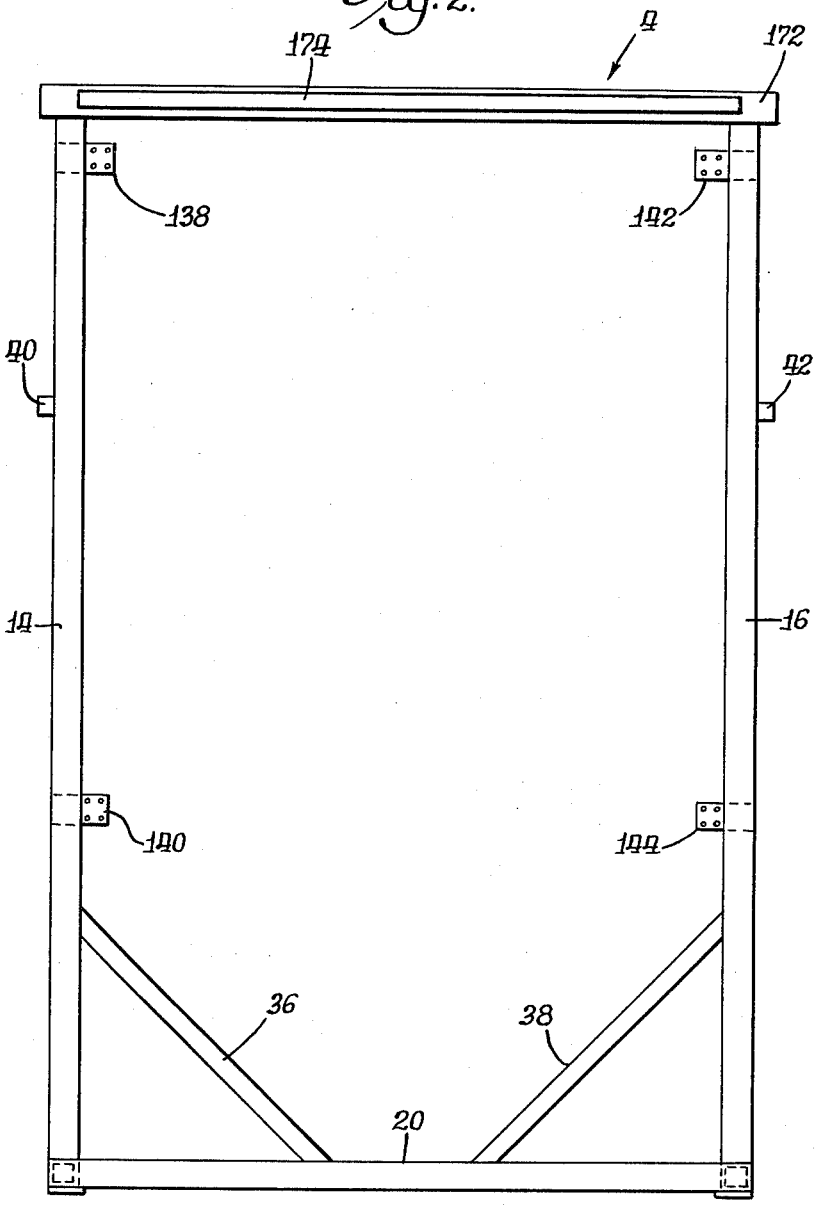
FIG. 2 is a front elevation of the frame of the apparatus.

It has been found that needle support bushings on the support and on an intermediate needle guide assembly substantially prevent needle deformation while the needles are thrust through the core. A continuous smooth reciprocation of the support is achieved by mounting the support on the frame with linear bearings on rigid guide rails and smoothly reciprocating the support thereon by a fluid actuated drive cylinder.

Briefly described, the improved apparatus of the invention comprises an upright stationary frame; a vertical support for holding the spring assembly for vertical reciprocation on the frame; a drive means for reciprocating the vertical assembly support; a plurality of needles mounted on the frame above the support, the needles being thrust through the assembly parallel to the top and bottom faces of the assembly upon reciprocation of the support; an intermediate needle guide assembly mounted on the frame above the support for reciprocal movement; and a plurality of needle guide bushings mounted on the support and intermediate needle guide assembly, the needles extending through and being supported by the needle guide bushings to preclude the needles from bowing and bending as the needles are thrust through the assembly mounted on the support. The reciprocation of the support is stabilized against lateral movement by mounting the support by means of frictionless linear bearings which slidably engage rigid rails on the stationary frame, and by driving the support up the rails with an endless cable powered by a fluid-activated cylinder to reciprocate the support relative to the frame along the rails.

Turning now to the drawings, FIG. 1, the apparatus includes a frame 4, a support 6 mounted on the frame for holding the assembly, a plurality of needles 8 mounted on the frame, an intermediate needle guide assembly 10 mounted on the frame spaced from and above the support, and a drive means 12 operatively attached to the support for reciprocal movements of the support and intermediate needle guide assembly.

Figure 8:
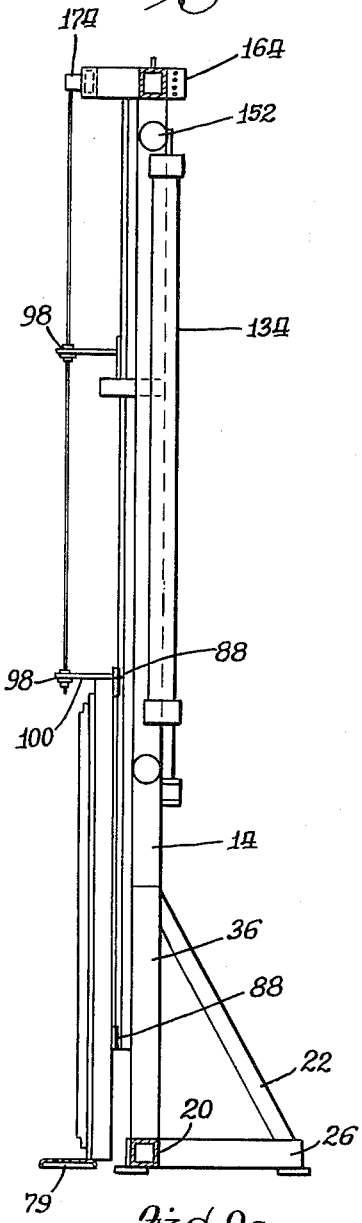
FIG. 8 is a side sectional view of the apparatus along line VIII—VIII of FIG. 3.
Figure 4:
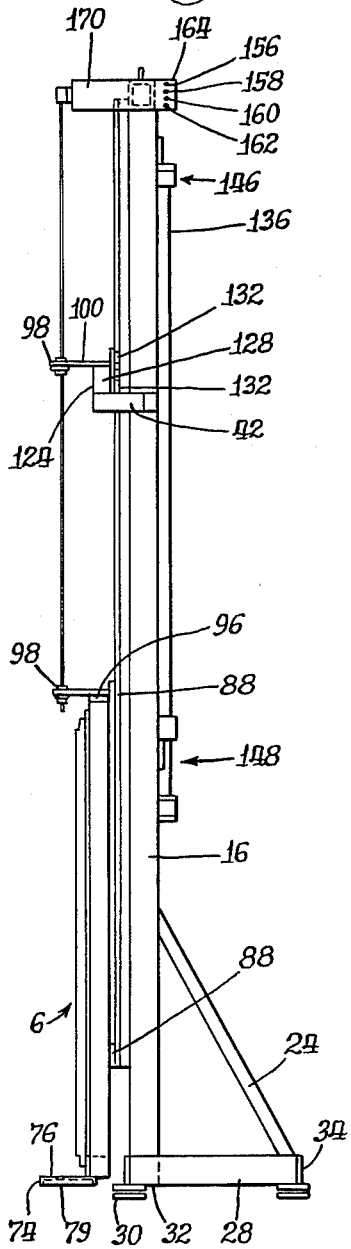
FIG. 4 is a side elevation of the apparatus.

As shown in FIG. 2, the frame 4 includes two spaced column members 14 and 16, which have square tubular cross sections, connected by a horizontal top member 18 (see FIG. 7) and a horizontal bottom member 20. As seen in FIGS. 4 and 8 respectively, two legs 22 and 24 extend angularly downwardly from the rear of each column, and two feet, 26 and 28, extend rearwardly from the bottom of each column to form a triangular bracing structure with the legs 22 and 24. Foot pads 30 at the heel 32 and toe 34 of each respective foot 26 and 28 provide a bearing surface with the floor. As shown in FIG. 2, angle braces 36 and 38, extending from the bottom member 20 to the columns 14 and 16, brace the frame in its own plane. Approximately two thirds up each column 14 and 16, the outerside surface of each column has stop members 40 and 42 respectively, perpendicularly extending forward the frame, the stop members serving as a support for the intermediate needle guide assembly, as will be further described.

Figure 3:
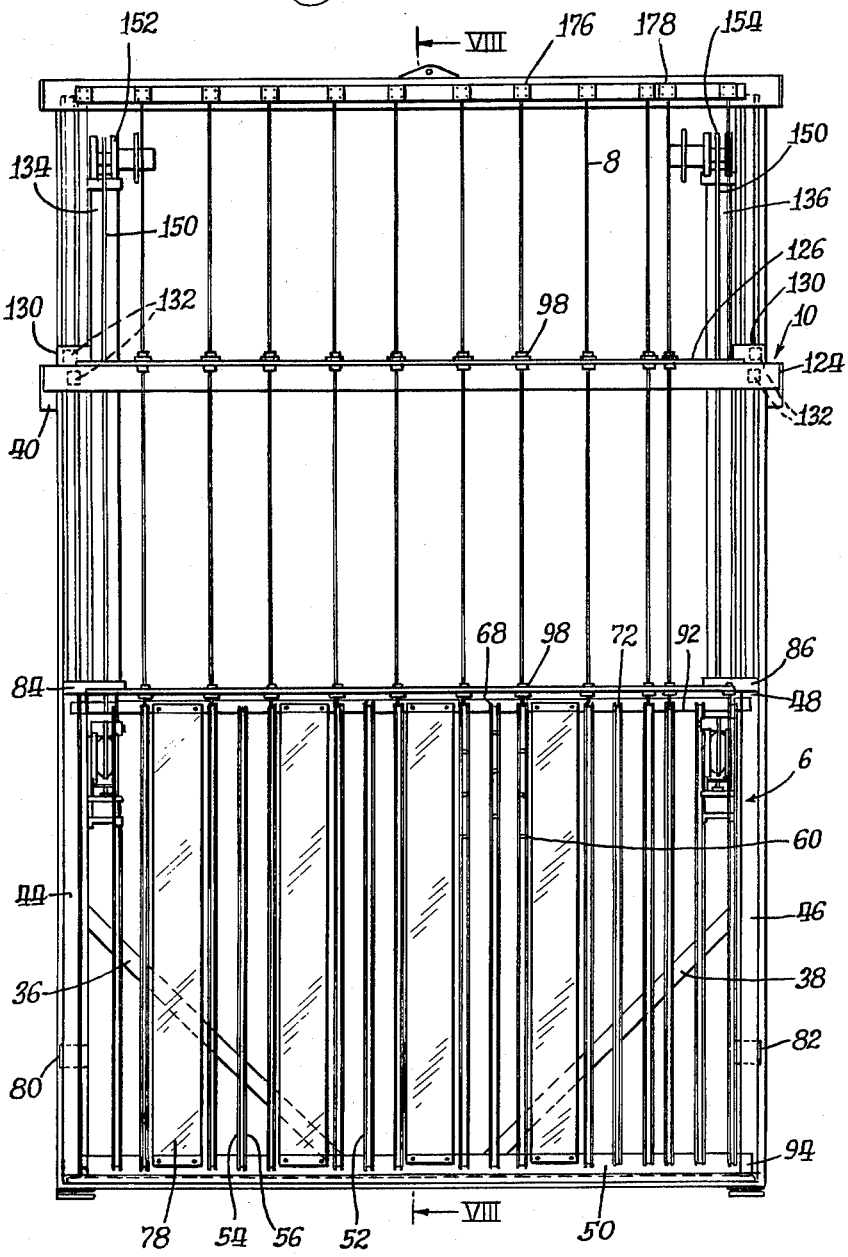
FIG. 3 is a front elevation of the apparatus with certain parts removed for clarity.

The support 6, as seen in FIGS. 1 and 3, is rectangular in shape and includes vertical side tubes 44 and 46, horizontal top cross tube 48 and horizontal bottom cross tube 50. Preferably these tubes are square and are 2 inch by 2 inch 11 gauge steel. Vertical finger guide brackets 52 extend between top and bottom cross tubes 48 and 50. The finger guide brackets are made of two flat bars 54 and 56 in parallel spaced relation. These bars are bolted together at intervals as at 58 with the wide flat surface of the bars in a plane parallel to the side tubes. Finger guides 60 extend forwardly, substantially perpendicularly, and from between flat bars 54 and 56. The finger guides are generally flat bars which are engaged between the bars of the finger guide bracket just above the bolts as at 58 which hold the bars of the bracket and finger guides together as a unit. As shown in FIG. 5, each finger guide has a C-shaped aperature 62, the aperatures being of a diameter to accomodate freely the needles 8. A slit 63, which permits the removal of the core from the support after the core is tied, extends from the aperature to the foward end of the finger guide. A gable shaped abutment 64, which assists in guiding the needle through the aperature, surrounds the aperature 62 with a ridge or peak 66 being arranged to face the point of the needle and being in a line parallel to the line of the wire in the turn of a spring in the core overlying the abutment. A reference finger is the bottom most finger on the finger guide brackets and is slightly shorter than the finger guides in that it does not perpendicularly extend out as far as the needles and does not have an aperature for the needles as do the finger guides lying above it.

For strength and stability, a formed rectangular backing channel 78 is affixed to and mounted vertically between the top and bottom cross tubes between the needle guide brackets-needle, as will hereinafter be described.

There are two types of finger guide brackets. There is a needle guide bracket-helper as at 68 and a needle guide bracket-needle as at 70. The needle guide brackets-needle and their associated finger guides are aligned with the needles 8, and the needles actually pass through and are guided by the aperatures 62 in the aligned finger guides. The needle guide brackets-helper and their associated finger guides are not aligned with the needles, but assist an operator assembling the core on the support by locating and supporting the strips of springs on the support. The finger guides on the finger guide brackets-needle not only have to be aligned vertically along the bracket to accommodate the needles, but also it is preferred that the finger guides on associated finger guide brackets-needle be in line horizontally. The finger guides on the finger guide brackets-helper also need to be in line horizontally, except it is preferred that these finger guides be on a horizontal line different from and intermediate to the finger guides on the finger guide brackets-needle. As a result, a staggered pattern of the finger guides appears when the support is viewed from the front, as seen in FIG. 3. Each finger guide bracket is secured to the horizontal top cross tube 48 and horizontal bottom cross tube 50 with a fastener such as a bolt and bracket or the like as at 72.

A pan 74 with a horizontal surface 76 is affixed to the horizontal bottom cross tube. The horizontal surface extends substantially perpendicularly forward the support and provides the initial support for the springs of the core being assembled on the support. The pan has a plurality of elongated aperatures 79 in line with and to accomodate the needles passing through the pan after they are thrust through the core.

Side tubes 44 and 46 have support mounting pads 80, 82, and 84, 86 mounted on the rear surface of the tubes. Support mounting pads 84 and 86 are mounted at the corners of the support where the cross top tube joins the vertical side tubes. Support mounting pads 80, 82 are mounted on the side tubes below 84, 86 respectively about one quarter up the support. Thompson open pillow blocks 88, which form part of a linear bearing means 90 and which will be more fully described, are mounted on each mounting pad.

Top and bottom needle guide mountings 92 and 94 are between the finger guide brackets 52 and the top and bottom cross tubes 48 and 50 on the front surface of such tubes. A top needle guide mounting bar 96 is mounted on the top surface of the top horizontal cross tube 48. The top needle guide mounting bar 96 serves as the mounting surface for a plurality of needle guide units 98 which are aligned with the needles 8. The guide units 98 provide a support surface, as will be described in further detail, to substantially preclude needle deformation. Each needle guide unit includes a needle guide bushing bracket 100, extending substantially perpendicularly from and forward of the needle guide mounting bar; an aperature in the bushing bracket which is fitted with a needle guide bushing 102 which provides a bushing support surface 104 to preclude needle deformation, as aforesaid; and a two piece collar 106 to anchor the needle guide bushing onto the bushing bracket. The needle guide bushing is preferably made of high density polyethylene known as UHMW however, Teflon or some other similar material may be used, as is known.

As shown in FIG. 5, the needle guide bushing has a funnel shaped aperature 108 wherein the aperature has a wide open mouth 110 which angularly narrows as at 112 to a cylindrical tunnel 114 with an interior support surface 104 which slidably supports the needles against deformation.

The support and intermediate guide assembly are stabilized against lateral movement by mounting the support and intermediate guide assembly on a linear bearing means for smooth reciprocation of the support and intermediate guide assembly. The linear bearing means includes a rail means and pillow blocks.

The rail means includes shaft support rails 115 and shafts 116 affixed thereto. The rail means is affixed by bolting, weldment, or the like to each column 14 and 16 of the frame 4, and vertically extend substantially the entire length of the columns. As shown in FIG. 6, the shaft support rails include a rail base 118 and a rail abutment member 120 perpendicularly extending therefrom. As it extends from the rail base, the abutment member slightly narrows in width, and then about $\frac{2}{3}$ its length linearly extends to an concave angular nose 122 which cradles shaft 116. The shaft 116 is bolted to the shaft support rail by a bolt or the like extending through the rail base 118 and center of the abutment member 120.

The support 6 is slidably mounted on the front of the frame 4 by inserting the shafts of the rail means through the four Thompson open pillow blocks 88 on the rear of the support. The pillow blocks have ball bearings which rollably engage the shafts on the shaft support rails, the shafts acting as an inner bearing race for the pillow blocks. The pillow blocks circumscribe the shafts except for a small open arc facing the rail base and shaft. As a result the support 6 is positively supported as it is moved up or down the frame on the shafts which act as the aforedescribed inner bearing race.

The intermediate guide assembly supports the needles against deformation at their intermediate length and includes a horizontal rectangular intermediate mounting tube 124, and intermediate needle guide mounting bar 126 mounted on and affixed to the intermediate tube 124, a plurality of needle guide units 98 perpendicularly extending forward the intermediate guide assembly, a cap 128 capping each end of the intermediate guide tube, and intermediate pillow block mounting brackets 130 mounted on each end of the rear surface of the intermediate mounting tube 124. The intermediate guide assembly extends horizontally between columns 14 and 16 and slightly beyond. The rectangular intermediate guide tube is preferably 2 inch by 3 inch rectangular aluminum tubing with a $\frac{1}{8}$ inch wall. The intermediate guide mounting bar 126 overlies the top surface of the intermediate mounting tube 124 and lies between needle guide bushing brackets 100 and the top surface of the tube 124. The brackets and needle guide units extend perpendicularly and forwardly the tube 124. The needle guide units are bolted to the intermediate mounting tube with bolts extending through the bushing brackets 100, intermediate needle guide mounting bar 126, and mounting tube 124. The needle guide units are aligned and plumbed with the needles such that the needles extend through the bushings, the needles being supported by the bushings against any deformation as they are thrust through the core during the assembling operation.

Two intermediate pillow blocks 132 are mounted on each of the intermediate pillow block mounting brackets 130 which are at each end of the mounting tube 124. The pillow blocks are mounted on the shafts 116 in the same manner as the support such that the intermediate guide assembly is positively supported against lateral movement by the linear bearing means as it slidably moves up and down the race created by the shaft and support rails on the front of and on each side of the frame.

In its rest position, each end of the intermediate guide assembly 10 rests on stop members 40 and 42 which are mounted on the outside surfaces of the columns 14 and 16 of the frame. As will be further described, the intermediate guide assembly is not moved up toward the top of the frame from its rest position until it is engaged by the top surfaces of the needle guide bushing brackets 98 which are mounted on the horizontal top cross tube 48 of support 6. The drive means for reciprocating the support and the intermediate guide assembly consists of two cable air cylinders 134 and 136 mounted on four cylinder mount plates 138, 140, 142, and 144 which are affixed, such as by a weldment, on the rear surface of the columns 14 and 16 of the frame. The cylinder mount plates are perpendicular to and extend inwardly the frame. The lower mount plates 140 and 144 are about one third up the length of the columns. The top mount plates 138 and 142 are spaced slightly below the top member 18 of the frame.

Cable air cylinders 134 and 136 are vertically bolted to mount plates 138, 140 and 142, 144 respectively such that the ends of the cylinder 146, 148 with the cable emanating therefrom are directed to the top and bottom of the frame respectively. It is preferred that about a 3 inch diameter high pressure cable cylinder is used such as the one manufactured by Tol-O-Matic, Inc. Minneapolis, Minn. and described in U.S. Pat. No. 4,057,257, which patent is incorporated as if fully rewritten herein.

Each cable air cylinder includes an endless cylinder cable 150 and cylinder pulley wheels 152 and 154 at each end of the cylinder over which the cable is mounted and which guide the cylinder cable. Each of the cables 150 is affixed to the horizontal top cross tube 48 of the support 6. Upon actuation, the air cylinders raise and lower the support 6 by pulling the cable up or down respectively. The air cylinders 152 and 154 are actuated by air lines 156, 158, 160, and 162 which are directed into an air manifold block 164 mounted at the center and on the rear surface of the top member of the frame, which then directs air by four lines into each cylinder, as is known.

Figure 7:
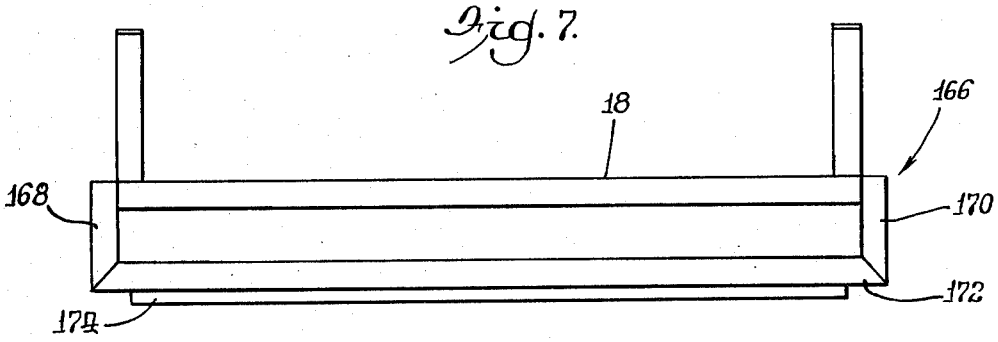
FIG. 7 is a top view of the apparatus.

A needle holding assembly 166 for holding a plurality of needles in a plane parallel to and forward the frame 4 is located at the top and forward of the frame. As shown in FIG. 7, the needle holding assembly includes extending arms 168 and 170 which extend forward the frame 4 from the outer side surface of columns 14 and 16 of the frame and opposite the ends of top member 18 of the frame. A needle cross bar 172 of square tubular cross section extends between extending arms 168 and 170 forward the frame and parallel to top member 18. A needle holding bracket 174 which is a long flat rectangular bar is mounted on the front surface of the needle cross bar 172. The needle holding bracket is tapped along its length for bolts to affix square needle holders 176 along the length of the needle holding bracket. Long steel needles with eyes or aperatures at their lower end, having a length sufficient to bring the point of the needle into the needle guide bushing mounted on the support, are mounted between the needle holding bracket and square needle holders. Bolts at each corner of the square needle holders hold the needles between the holders and the bracket in a downwardly pointing direction. The needles extend through the needle guide bushing of the needle guide units which are mounted on the support and the intermediate guide assembly. The needles are mounted such that they are carefully aligned with the aperatures in the finger guides mounted on the needle guide brackets-needle on the support.

In practice it is preferred to have 12 needles mounted on the needle holding assembly with the needles being spaced, as at 178, to accommodate cores for mattresses of various lengths on the support.

Figure 9A:
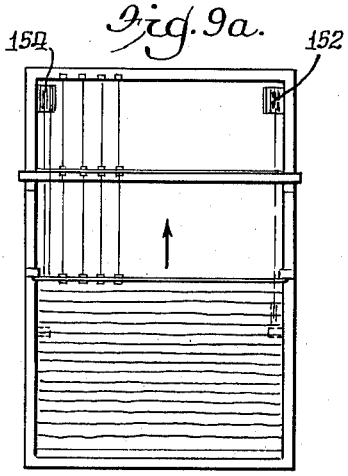
FIG. 9 is a diagrammatic view of the support of the apparatus moving from its lower most to its upper most positions.
Figure 9B:
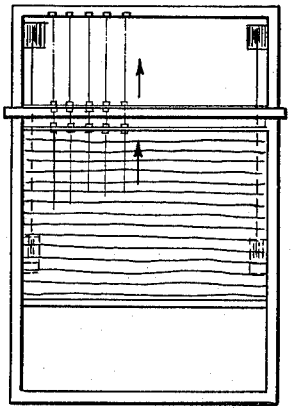
Figure 9C:
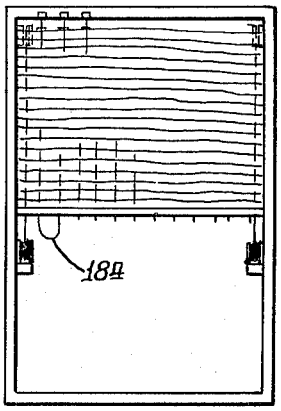

To assemble the core, a strip of spring filled pockets is laid on the pan with the open end of the springs facing forward and rearward the apparatus. The support is moved by the cable cylinder by means of a switch or a kick switch (not shown) to various positions to suit the operator during the assembling of the pockets on the needle guide brackets-needle and needle guide brackets-helper, as shown in FIG. 9. The strip of pockets is arranged in rows on the needle guide brackets to the desired length and width of the core. After the strip of pockets is arranged in rows to a desired width, the support is raised to thrust the needles through the core at a point approximately intermediate the open ends of the springs. As shown in FIG. 9, as the support is raised along the shafts and shaft supports of the linear bearing means, the top of the support engages the intermediate guide assembly at about two thirds the height of the frame. As the support continues to rise, it pushes the intermediate needle guide assembly up along the shaft and shaft support rail on each column of the frame. As the support rises as aforesaid, the needles are thrust through the core and are supported against bending and deformation by the needle guide bushings on the support and on the intermediate needle guide assembly. The bushings on the needle guide assembly provide important support at a point generally intermediate the length of the long needles.

Although in the embodiment shown and described, the intermediate guide assembly is actuated and moved by the support, it could be moved upward independently of the support. When the support and intermediate guide assembly reach the top of the frame and their cycle, the needles are thrust completely through the core, the aperatures in the needle guide assembly brackets-needle, the slot-like aperatures in the pan at the base of the support, and extend below the pan. At the upper most point in the cycle, twine is threaded through the eyes of adjacent needles to each side of a line of needle guide brackets-helper to form half-loops 184 depending from each pair of needles. After the needles are threaded as aforesaid, the cable cylinder is actuated to lower the support, pull the core down from the needles, and pull the twine through the core to form a plurality of bights composed of the plurality of lengths of twine pulled through the core and which loop around two adjacent springs. When the core reaches the lower most cycle, the intermediate guide assembly is at rest on stop members 40, 42, the support is lowered, and the twine is removed from the needles and is tied at the top of the core. The core then is removed from the support to start another assembling operation.

During the reciprocation of the support 6, the pillow blocks in combination with the shafts on the rails provide a continuous firm support race with the cable cylinder providing a smooth actuating and driving means not heretofore known or used in the manufacture of spring pocketed cores for an inner spring construction mattress. Further, the needle guide bushings both on the support and intermediate guide assembly integrate themselves into the smooth acting drive mechanism and race to avoid if not substantially preclude needle deformation and breakage in the manufacture of spring pocketed mattress cores.

While the present invention has been shown and described with respect to a specific preferred embodiment thereof, it should be apparent that various modifications, adaptations, and variations may be made utilizing the teachings of the present disclosure without departing from the scope of the invention, and are intended to be within the scope of the following claims.

Various features of the invention are set forth in the following claims.

What is claimed is:

1. A mattress core manufacturing apparatus for making a core unit out of an assembly of coiled wire springs having a pair of spaced end coils representing the top and bottom faces of the assembly, the apparatus comprising:

a frame;

a support for holding said assembly, said support mounted on the frame for reciprocal movement relative to said frame;

a plurality of needles mounted on said frame, said needles being thrust through said assembly between said top and bottom faces thereof upon reciprocation of said support relative said frame;

an intermediate needle guide assembly mounted on said frame spaced from said support for reciprocal movement relative to said frame;

a drive means operatively attached to said support for reciprocal movement thereof;

a plurality of needle guide bushings mounted on said support and intermediate needle guide assembly; and said needle guide bushings including a bushing surface for said needles to prevent said needles from bending as the support reciprocates relative to said frame and said needles are thrust through the assembly held by said support.

2. An apparatus as recited in claim 1 further comprising a linear bearing means including a rail means and pillow block means, said pillow block means slidably engaging said rail means, and said support mounted on said frame with said linear bearing means for reciprocal movement of said support relative to said frame.

3. An apparatus as recited in claims 1 or 2 wherein said intermediate guide assembly is mounted on said frame with said linear bearing means for reciprocal movement of said intermediate guide assembly relative to said frame.

4. An apparatus as recited in claim 2 wherein said drive means comprises a fluid pressure actuated cable cylinder, said cable cylinder including a cable means, and said support being attached to said cable means for reciprocal movement relative to said frame upon actuation of said cable cylinder.

5. A mattress core manufacturing apparatus for making a core unit out of an assembly of coiled wire springs having a pair of spaced end coils representing the top and bottom faces of the assembly, the apparatus comprising:

a frame;

a support for holding said assembly, said support mounted on the frame for reciprocal movement relative to said frame;

at least two needles mounted on said frame, said needles being thrust through said assembly between the top and bottom faces thereof upon reciprocation of said support relative to said frame;

an intermediate needle guide assembly mounted on said frame spaced from said support for reciprocal movement relative to said frame;

a fluid pressure actuated cable cylinder, said cable cylinder including a cable means being attached to said support for reciprocal movement of said support relative to said frame upon actuation of said cable cylinder;

needle guide bushings mounted on said support and said intermediate needle guide assembly, said needle guide bushings including a support surface circumscribing said needles to prevent said needles from bending as the support reciprocates relative to said frame and said needles are thrust through said assembly held by said support; and linear bearing means including a rail means vertically mounted on said frame, and pillow blocks mounted on said support and said intermediate guide assembly for reciprocal movement of said support and intermediate guide assembly along said frame and said rail means upon actuation of said cable cylinder.

6. An apparatus as recited in claim 5 wherein said rail means includes a shaft support rail and shaft affixed thereto, and said shaft extending through said pillow blocks.

* * * * *